US006966972B2

(12) United States Patent
Trochlil et al.

(10) Patent No.: US 6,966,972 B2
(45) Date of Patent: Nov. 22, 2005

(54) COATING COMPOSITION, PAPER PRODUCT HAVING FLEXIBLE COATING AND METHOD FOR MANUFACTURING A PAPER PRODUCT

(75) Inventors: Thomas R. Trochlil, Rhinelander, WI (US); John A. Theisen, Rhinelander, WI (US); Bruce C. Unruh, Harshaw, WI (US); John E. Katchko, Rhinelander, WI (US)

(73) Assignee: Wausau Paper Corp., Mosinee, WI (US)

( * ) Notice: Subject to any disclaimer, the term of this patent is extended or adjusted under 35 U.S.C. 154(b) by 274 days.

(21) Appl. No.: 10/304,455

(22) Filed: Nov. 25, 2002

(65) Prior Publication Data

US 2004/0099390 A1 May 27, 2004

(51) Int. Cl.[7] ..... D21H 19/38; D21H 19/44; D21H 19/54

(52) U.S. Cl. ..... 162/135; 162/158; 162/164.1; 162/164.6; 162/181.1; 162/181.2; 162/181.8; 162/206; 428/341; 427/391

(58) Field of Search ..... 162/135, 158, 162/164.1, 164.6, 181.1–181.2, 181.7–181.8, 162/165–166, 204–206; 427/361, 391; 428/340–342

(56) References Cited

U.S. PATENT DOCUMENTS

| | | | | |
|---|---|---|---|---|
| 2,185,859 | A * | 1/1940 | Massey | 162/184 |
| 2,537,114 | A | 1/1951 | Young et al. | |
| 2,661,309 | A | 12/1953 | Azorlosa | |
| 3,276,359 | A * | 10/1966 | Oransky et al. | 427/144 |
| 3,856,564 | A | 12/1974 | Kirkham | |
| 4,503,118 | A * | 3/1985 | Murakami et al. | 428/323 |
| 4,867,844 | A * | 9/1989 | Dessauer | 162/135 |
| 5,270,103 | A * | 12/1993 | Oliver et al. | 428/219 |
| 5,989,696 | A | 11/1999 | McCarthy et al. | |
| 6,335,102 | B1 * | 1/2002 | Tsubaki et al. | 428/513 |
| 6,537,363 | B1 * | 3/2003 | Golley et al. | 106/486 |
| 6,572,951 | B2 * | 6/2003 | Hasegawa et al. | 428/141 |
| 2002/0064672 | A1 * | 5/2002 | Tsubaki et al. | 428/535 |
| 2003/0085012 | A1 * | 5/2003 | Jones et al. | 162/181.8 |
| 2003/0094120 | A1 * | 5/2003 | Golley et al. | 106/486 |
| 2004/0099390 | A1 * | 5/2004 | Trochlil et al. | 162/135 |

FOREIGN PATENT DOCUMENTS

| | | | | |
|---|---|---|---|---|
| EP | 234724 | A1 * | 9/1987 | C08F 220/22 |
| EP | 892819 | B1 * | 7/2000 | C08F 220/10 |

OTHER PUBLICATIONS

S. A. Walken, "SizingwithAKD-Review of Trends, Theories, and Pratical in-Mill Application and Troubleshooting", Oct. 16-18, 1990, Tappi Neutral/Alkaline papermaking Short Course, pp. 67-70.*

L. Westfelt, "Chemistry of Paper Wet-Strength. I.A Survey of Mechanisms of Wet-Strength Develoment," 1979, Cellulose Che. Technol. vol. 13, pp. 813-825.*

"Cracking At The Fold," Presentation by Jamel Attal and S. Jones, *The Dow Chemical Company*, pp. 1-39 (Sep. 1996).

Operator and Maintenance Manual—Supercalender, Valmet Company, pp. 2-14 (Dec. 1999).

"Pigment Coating and Surface Sizing of Paper", by Esa Lehtinen, Helsinki: Fapet Oy, p. 26 (2000).

"Product Specifications—Starch Copolymer Technology," Penford Products, Co., front cover, p. 11, (Nov. 2000).

"Ask Dow", by Jamel Attal, *It's All About Paper*, p. 8, vol. 2, Issue 1 (Apr. 2001).

Speedsizer® Operation and Maintenance Manual, Voith Sulzer Paper Technology, p. 54 and Figure 2.1 , date unknown.

* cited by examiner

*Primary Examiner*—José A. Fortuna
(74) *Attorney, Agent, or Firm*—Merchant & Gould P.C.

(57) ABSTRACT

A paper product is described that includes a paper substrate having a first surface and a second surface; a coating layer provided on the first surface of the paper substrate, the coating layer comprising a binder component and a pigment component, wherein the weight ratio the binder component to the pigment component is between about 0.25:1 to about 1:1; and wherein the paper product exhibits a gloss of at least about 20 to 75 according to TAPPI T480 om-92, a Print-surf roughness of at least about 0.5 to 2.5 according to TAPPI T555 pm-94, and a density of at least about 12 to 18 according to TAPPI T410 om-93 and TAPPI T411 om-89. A method for manufacturing a paper product is provided.

27 Claims, 1 Drawing Sheet

COATING COMPOSITION, PAPER PRODUCT HAVING FLEXIBLE COATING AND METHOD FOR MANUFACTURING A PAPER PRODUCT

FIELD OF THE INVENTION

The invention relates to a coating composition, a paper product having a flexible coating, and to a method for manufacturing a paper product having a flexible coating. In particular, the coating composition provides a flexible coating when applied to a paper substrate and can receive printing while reducing the occurrence of cracking at the fold.

BACKGROUND OF THE INVENTION

When coated paper products are folded, there exists a tendency for cracks to develop at the fold. This cracking can be referred to as flex cracking or cracking at the fold. Paper products that are often subjected to folding are often found in magazines, books, bags, and boxes. Flex cracking or cracking at the fold can be either cosmetic or may lead to a complete paper failure at the location of the fold. A cosmetic cracking can be characterized by a small disruption of the coating layer at the location of the fold, making the fold unappealing, especially if the fold is in a heavily inked area.

Factors that effect cracking at the fold include changes in humidity as a result of seasonal changes and the chemistry of the paper substrate, the coating, the ink, and the techniques for processing and manufacture. Cracking at the fold may become more noticeable if heavy colors are used at fold areas.

Several techniques are available for reducing cracking at the fold. One technique involves selecting a latex for the coating layer. Another technique is to increase the moisture in the coated paper. Increasing the moisture level can lead to other coating defects, such as, blister. These techniques are described by Attal, "Ask Dow," It's All About Paper, Vol. 2, Issue 1, April 2001, Page 8.

SUMMARY OF THE INVENTION

Figure 1:
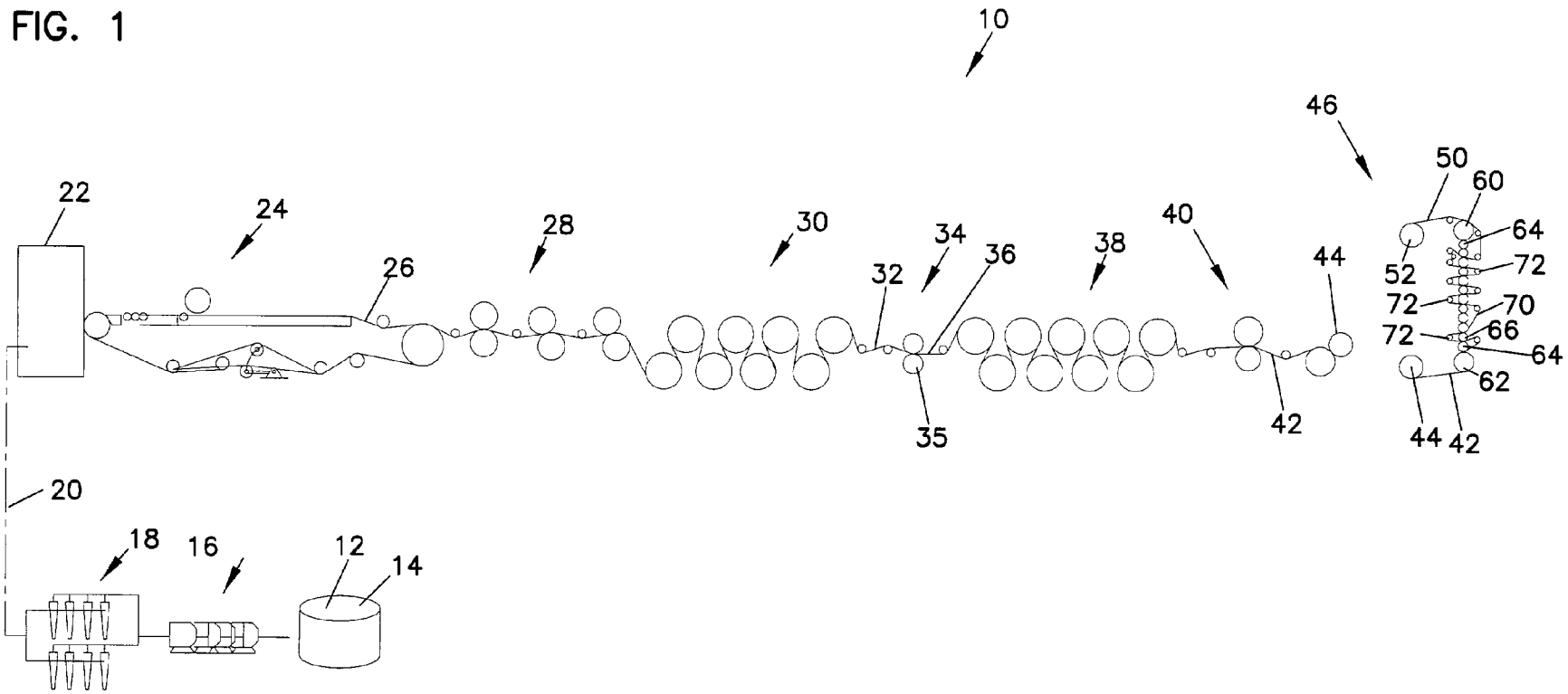
FIG. 1 is a diagrammatic view of an exemplary process for manufacturing a coated paper product according to the invention.

A coating composition is provided according to the invention. The coating composition can include about 8 wt. % to about 30 wt. % binder component, about 20 wt. % to about 48 wt. % pigment component, and about 35 wt. % to about 60 wt. % water. The weight ratio of the binder component to the pigment component can be between about 0.25:1 and about 1:1.

The binder component can include at least one of starches, latex/starch polymer, proteins, water-soluble polymers, synthetic polymers, and mixtures thereof. The pigment component can include at least one of delaminated clay, kaolin clay, titanium dioxide, natural ground calcium carbonate, precipitated calcium carbonate, calcined clay, alumina trihydrate, precipitated amorphous silica, talcum, gypsum, plastic pigments, and mixtures thereof. When the pigment component is provided as a mixture, the pigment component can include at least 80 wt. %, based on the weight of the pigment component, of delaminated clay, and can include between about 2 wt. % and about 20 wt. %, based on the weight of the pigment component, of another pigment such as titanium dioxide. The coating composition can additionally include additives such as rheology modifiers, lubricants, defoamers, dyes, dispersants, insolubilizers, and preservatives.

A paper product is provided according to the invention. The paper product can include a paper substrate having a first surface and a second surface, and a coating layer provided on the first surface of the paper substrate. The coating layer can include a binder component and a pigment component. The paper product can exhibit a gloss of between about 20 and about 75 according to TAPPI T480 om-92, a Print-surf roughness of between about 0.5 and about 2.5 according to TAPPI T555 pm-94, and a density of between about 12 and about 18 according to TAPPI T410 om-93 and TAPPI T411 om-89.

A paper product according to the invention can be characterized as a result of calendering the coating composition applied to a paper substrate with a roll provided at a temperature of at least about 240° F. Exemplary calendering processes include supercalendering and soft nip calendering.

A method for manufacturing a paper product is provided according to the invention. The method includes a step of forming a paper substrate and drying the paper substrate to a water content of between about 0.5 wt. % and about 5 wt. %, and applying a coating composition to a surface of the paper substrate and forming a coating layer. The method can include a step of calendering the paper substrate and coating layer at a roll temperature of at least about 240° F. Exemplary calendering techniques include supercalendering and soft nip calendering.

DETAILED DESCRIPTION OF THE PREFERRED EMBODIMENT

A paper product can be provided according to the invention having a flexible coating that reduces the occurrence flex cracking. The term "flex cracking" refers to the existence of cracking at the fold of a paper product when the paper product is folded. By controlling the coating composition that is applied to a paper substrate and by controlling the finish of the coated paper product, flex cracking can be reduced.

The coating composition can be applied to a paper substrate to provide a coated paper product. The coating composition is available as a dispersion containing pigment, binder, and water as the largest components of the composition. Additional components that can be incorporated into the coating composition include additives such as rheology modifiers, lubricants, defoamers, dyes, dispersants, insolubilizers, and preservatives.

The coating composition is provided as a flowable dispersion that can be applied to a surface of a paper substrate to form a coating layer thereon. The coating composition should be sufficiently flowable to allow it to be applied using conventional paper coating equipment, such as, a metering film size press.

The pigment component of the coating composition provides a surface on the coating layer that accepts printing. There should be a sufficient amount of pigment in the coating composition so that the resulting coating layer can receive printing in commercial printing facilities. A concentration of pigment in the coating composition that is too high can result in rheology problems during application of the coating composition and can result in the possibility of dusting if there is pigment that is not bound to the paper substrate. The pigment component is generally provided as a particulate dispersed in the binder component and the water. Examples of the pigment component include delaminated clay, kaolin clay, titanium dioxide, calcium carbonate (precipitated and natural ground), calcined clay, alumina trihydraie, precipitated amorphous silica, talcum, gypsum, plastic pigments, exters, and mixtures thereof. The coating composition can include the pigment component in an amount of between about 20 wt. % and about 48 wt. %. In addition, the pigment component can be provided in an amount of between about 32 wt. % and about 43 wt. %, and between about 36 wt. % and about 40 wt. %, and at about 38 wt. %. The weight percent is based upon a 100% solids component. The pigment component can include a combination of delaminated clay and another pigment. The pigment component can include at least about 80 wt. %, based on the weight of the pigment component, of delaminated clay, and can include up to about 20 wt. %, based on the weight of the pigment component, of another pigment such as titanium dioxide. When titanium dioxide is included in the pigment component, it is preferably included in an amount of at least about 2 wt. % based on the weight of the pigment component.

The binder component is provided to adhere the pigment component to the paper substrate. It is believed that prior art coating compositions minimize the amount of the binder component in the coating composition because the binder component is considered to be the most expensive component of the coating composition. The applicants discovered that by increasing the concentration of the binder component in the coating composition and enhancing the finishing technique, it is possible to decrease the occurrence of flex cracking. In general, the applicants have found that the binder component can be provided in an amount of at least about 8 wt. % in the coating composition to provide a coating layer on a paper substrate that, when processed according to the invention, exhibits reduced flex cracking compared with prior art coating compositions containing a lower level of the binder component and not being processed according to the invention. The coating composition can contain between about 8 wt. % and about 30 wt. % of the binder component. In addition, the binder component can be provided in an amount of between about 13 wt. % and about 20 wt. %, and between about 15 wt. % and about 18 wt. %, and at about 17 wt. %. The weight percent is based upon a 100% solids component.

Exemplary binder components that can be incorporated into the coating composition include starches, proteins, water-soluble polymers, synthetic binders and mixtures thereof. Exemplary starches include corn starch, potato starch, wheat starch, tapioca starch, unmodified pearl starch, oxidized starch, ethylated starch, and cationic starch. Exemplary proteins include soy based proteins, and casein. Exemplary water soluble polymers include polyvinyl alcohol and alkali soluble emulsions. An exemplary alkali soluble emulsion includes solubilized polyacrylate polymer. Exemplary synthetic binders include styrene butadiene, polyvinyl acetate, styrene acrylate, and acrylates.

The coating composition includes water in an amount sufficient to provide the coating composition with desired flowability properties. That is, the coating composition should be sufficiently flowable to allow it to be applied to a paper substrate and form a continuous coating on the paper substrate. It is believed that an insufficient amount of water will create rheology problems that can lead to streaking. In addition, too much water can reduce coverage of the binder component and the pigment component on the paper substrate. It is expected that the water will be present in the coating composition in an amount of between about 35 wt. % and 60 wt. %, and can be present in an amount of between about 40 wt. % and about 55 wt. %, between about 43 wt. % and about 47 wt. %, and at about 45 wt. %. Alternatively expressed, it is believed that the coating composition can have a solids content of between about 40 wt. % and about 65 wt. %, where the "solids content" refers to the non-water components in the coating composition. The solids content can be between about 45 wt. % and about 60 wt. %, between about 53 wt. % and about 57 wt. %, and at about 55 wt. %.

Another way of characterizing the amounts of the binder component and the pigment component can be as parts by weight or as a weight ratio where the binder component and the pigment component are expressed on a dry, weight basis. In general, it is believed that the coating composition can include between about 25 parts to about 100 parts of the binder component per 100 parts of the pigment component. In addition, the weight ratio of the binder component to the pigment component can be between about 0.25:1 and about 1:1, and can be between about 0.35:1 and about 0.7:1.

Various components that can be provided in the coating composition including the pigment component, the binder component, and the various additives are identified in Lehtinen, Esa, *Pigment Coating and Surface Sizing of Paper*, Helsinki: Fapet Oy, 2000. The entire disclosure of this publication is incorporated herein by reference.

The coating composition can be applied to the paper substrate either online during the manufacture of the paper substrate or off-line after the manufacture of the paper substrate. It is advantageous that the coating composition can be applied to the paper substrate soon after the paper substrate is manufactured and without having to ship the paper substrate to a separate facility for application of the coating composition.

Now referring to FIG. 1, a process for the manufacturer of a paper product according to the invention is shown at reference numeral 10. It should be understood that schematic diagram 10 is an exemplary schematic diagram and includes many of the operations carried out in commercial paper making facilities. The equipment used in a particular operation may very from facility to facility, but it is expected that the general operations will be present.

The starting material 12 generally includes wood pulp 14. The wood pulp can include a blend of hard wood and soft wood fibers. The wood pulp can be provided as cellulose fiber from chemical pulped wood, and can include a blend from coniferous and deciduous trees. The wood pulp 14 can be processed through a refining operation 16 and through a cleaning operation 18. The cleansed pulp 20 is then applied through a head box 22 onto a fourdrinier machine 24 to provide a paper base sheet 26. Certain additives can be added prior to the head box 22 and can be referred to as "wet end chemistry." Wet end additives can be provided for sizing, strength, water resistance, and/or oil resistance. Exemplary water resistance additives include rosin and alkylketene dimer (AKD). Exemplary oil resistance additives include fluorochemicals. Exemplary strength additives include urea formaldehyde and polyamide.

The paper base sheet 26 can be characterized as a non-woven web and can be considered continuous in the machine direction. The paper base sheet 26 can be processed through a wet press section 28 to remove water, and then through a drier section 30 to further reduce the water content and provide a paper substrate 32. The paper substrate 32 can be dried to a moisture level of between about 0.5 wt. % to about 5 wt. %.

The paper substrate 32 is processed through a size press 34 for the application of a coating composition onto the paper substrate 32 to provide a coated paper product 36. The size press 34 is provided as a metering film size press 35. The coated paper product 36 is then dried in a second drier section 38 and calendered in a machine calender 40 to provide a calendered paper product 42. Although FIG. 1 shows a supercalender 46 off line from the paper making and coating line, the supercalender 46 can be provided on line. The calendered paper product 42 is then taken up on a reel 44. The calendered paper product 42 can then be processed by a supercalender 46 where the rolls are provided at a temperature of at least about 240° F. to provide a supercalendered paper product 50. The supercalendered paper product 50 can be taken up on a reel 52. In general, it is expected that the supercalender 46 will have rolls provided at a temperature of between about 240° F. and about 500° F. The rolls of the supercalender 46 can be provided at a temperature of between about 300° F. and about 500° F. It is expected that the rolls of the supercalender can be provided at a temperature of about 400° F. The supercalendered paper product 50 can then be sent to a winder for cutting and subsequent distribution.

The coating composition can be applied to the paper substrate having a weight of between about 20 lbs./3,000 ft.$^2$ and about 100 lbs./3,000 ft.$^2$ using the metering film size press to provide coat weights of between about 2 lbs./3,000 ft.$^2$ to about 4 lbs./3,000 ft.$^2$ the coat weight can be between about 2.5 lbs./3,000 ft.$^2$ and about 3.5 lbs./3,000 ft.$^2$, and can be provided at about 3 lbs./3,000 ft.$^2$. In contrast, many prior art coated paper products that exhibit undesirable levels of cracking at the fold are manufactured with coat weights of 5 to 10 lbs./3,000 ft.$^2$.

It is believed that the combination of the coating composition, the low coat weight, and the finishing step of calendering at a roll temperature of between about 240° F. and about 500° F. improves the flex cracking resistance of the resulting coated paper product. By calendering at a higher temperature than conventional machine calendering, and by providing a coating composition according to the invention, it is possible to provide a lower coat weight or a thinner coating layer on the paper substrate. It is believed that the coating composition, when calendered at a roll temperature of at least about 240° F., will provide a more extensible coating that stretches instead of cracking. In addition, it is believed that the surface will be more of a hybrid surface, and that the fibers in the paper substrate will act to reinforce the surface.

It is expected that supercalendering the coating composition will improve flex crack resistance by allowing the manufacturer to produce a coated paper product having a coat weight that is lower than traditional coated paper products. By reducing the coat weight while retaining a desired print surface, it is expected that flex crack resistance will improve. In addition, it is believed that supercalendering the coated paper product provides a better distribution of the coating layer across a paper substrate and provides better binding of the pigment to the paper fibers. As a result of better binding, it is believed that there will be a lesser tendency of the pigments to break away from the fibers when subjected to folding.

It is expected that supercalendering can cause the paper substrate to become thinner, and that a thinner paper substrate will be more desirable because flex cracking will be less likely to occur while the paper substrate retains its physical properties. In addition, it is expected that a thinner paper product having desired physical properties will be a more desirable product than another paper product having the same physical strength properties but being thicker.

A supercalender operation is generally considered to be different from a machine calendering operation. During machine calendering, the pressure between the nips is generally less than about 1,000 pli (pound per lineal inch) and is commonly between about 200 pli and 400 pli. Supercalendering involves nip pressures between about 1,000 pli and about 4,000 pli. It is expected that the paper product according to the invention can be achieved at nip pressures of up to 2,500 pli. In addition, a supercalendering operation generally includes alternating soft rolls and steel rolls wherein the steel rolls are often provided at a temperature in excess of 240° F. As shown in FIG. 1, the exemplary supercalender 46 includes top and bottom steel rolls 60 and 62, and alternating soft rolls 64 and steel rolls 66. The coated paper product 70 can be threaded through the rolls in any desired configuration by use of the carrier rolls 72.

The resulting coated paper product can be characterized as exhibiting a gloss of at least about 20 according to TAPPI T480 om-92, a Print-surf roughness of less than about 2.5 according to TAPPI T-555 pm-94, and a density of at least 12 according to TAPPI T410 om-93 and TAPPI T411 om-89. The coated paper product can be characterized as exhibiting a gloss of between about 20 and about 75, a Print-surf roughness of between about 0.5 and about 2.5, and a density of between about 12 and about 18.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A paper product comprising (a) a paper substrate having a first surface and a second surface;

(b) a coating layer provided on the first surface of the paper substrate, the coating layer comprising a binder component and a pigment component, wherein the weight ratio of the binder component to the pigment component is between about 0.25:1 and about 1:1; and (c) wherein the paper product exhibits a gloss of between about 20 and about 75 according to TAPPI T480 om-92, a Print-surf roughness of about 0.5 and less than about 2.5 according to TAPPI T555 pm-94, and a density of between about 12 and about 18 according to TAPPI T410 om-93 and TAPPI T411 om-89.

2. A paper product according to claim 1, wherein the binder component comprises at least one of starches, proteins, water soluble polymers, synthetic polymers, and mixtures thereof.

3. A paper product according to claim 1, wherein the binder component comprises a latex/starch polymer.

4. A paper product according to claim 1, wherein the pigment component comprises at least one of delaminate clay, kaolin clay, titanium dioxide, natural ground calcium carbonate, precipitated calcium carbonate, calcined clay, alumina trihydrate, and precipitated amorphous silica, talcum, gypsum, plastic pigments, and mixtures thereof.

5. A paper product according to claim 1, wherein the pigment component comprises at least about 80 wt. %, based on the weight of the pigment component, of delaminated clay.

6. A paper product according to claim 5, wherein the pigment component comprises between about 2 wt. % and about 20 wt. %, based on the weight of the pigment component, of titanium dioxide.

7. A paper product according to claim 1, wherein the coating layer further comprises at least one of rheology modifiers, lubricants, defoamers, dyes, dispersants, insolubilizers, and preservatives.

8. A paper product according to claim 1, wherein the paper substrate comprises cellulose fiber from chemical pulped wood comprising a blend from coniferous and deciduous trees.

9. A paper product according to claim 1, wherein the paper substrate comprises a water resistance additive comprising at least one of rosin and alkylketene dimer.

10. A paper product according to claim 1, wherein the paper substrate comprises a strength additive comprising at least one of urea formaldehyde and polyamide.

11. A paper product according to claim 1, wherein the paper substrate comprises an oil resistance additive comprising a fluorochemical.

12. A paper product according to claim 1, wherein the paper substrate has a weight of between about 20 lbs./3,000 ft.$^2$ and about 100 lbs./3,000 ft.$^2$.

13. A paper product according to claim 1, wherein the coating layer has a weight of between about 2 lbs./3,000 ft.$^2$ and about 4 lbs./3,000 ft.$^2$.

14. A method for manufacturing a paper product comprising:

(a) forming a paper substrate and drying the paper substrate to a water content of between about 0.5 wt. % and about 5 wt. %;

(b) applying a coating composition to a surface of the paper substrate, and forming a coating layer, the coating composition comprising:

(i) about 8 wt. % to about 30 wt. % binder component;

(ii) about 20 wt. % to about 48 wt. % pigment component; and (iii) about 35 wt. % to about 60 wt. % water; and (c) calendering the paper substrate and coating layer by application of a calender roll thereto, wherein the calender roll is provided at a temperature of at least about 240° F. to provide a paper product exhibiting a gloss of at least about 20 according to TAPPI T480 om-92, a Print-surf roughness of less than about 2.5 according to TAPPI T555 pm-94, and a density of at least about 12 according to TAPPI T410 om-93 and TAPPI T411 om-89.

15. A method according to claim 14, wherein the binder component comprises at least one of starches, latex/starch polymer, proteins, water soluble polymers, synthetic polymers, and mixtures thereof.

16. A method according to claim 14, wherein the weight ratio of the binder component to the pigment component is between about 0.25:1 and about 1:1.

17. A method according to claim 14, wherein the pigment component comprises at least one of delaminate clay, kaolin clay, titanium dioxide, natural ground calcium carbonate, precipitated calcium carbonate, calcined clay, alumina trihydrate, and precipitated amorphous silica, talcum, gypsum, plastic pigments, and mixtures thereof.

18. A method according to claim 14, wherein the pigment component comprises at least about 80 wt. %, based on the weight of the pigment component, of delaminated clay.

19. A method according to claim 18, wherein the pigment component comprises between about 2 wt. % and about 20 wt. %, based on the weight of the pigment component, of titanium dioxide.

20. A method according to claim 14, wherein the coating layer further comprises at least one of rheology modifiers, lubricants, defoamers, dyes, dispersants, insolubilizers, and preservatives.

21. A method according to claim 14, wherein the paper substrate comprises cellulose fiber from chemical pulped wood comprising a blend from coniferous and deciduous trees.

22. A method according to claim 14, wherein the paper substrate comprises a water resistance additive comprising at least one of rosin and alkylketene dimer.

23. A method according to claim 14, wherein the paper substrate comprises a strength additive comprising at least one of urea formaldehyde and polyamide.

24. A method according to claim 14, wherein the paper substrate comprises an oil resistance additive comprising a fluorochemical.

25. A method according to claim 14, wherein the paper substrate has a weight of between about 20 lbs./3,000 ft.$^2$ and about 100 lbs./3,000 ft.$^2$.

26. A method according to claim 14, wherein the calendered coating composition has a weight of between about 2 lbs./3,000 ft.$^2$ and about 4 lbs./3,000 ft.$^2$.

27. A method according to claim 14, wherein the calender roll is provided at a temperature of about 300° F. to about 500° F.

* * * * *